United States Patent [19]

Clark

[11] 4,062,481

[45] * Dec. 13, 1977

[54] PISTOL HOLSTER

[75] Inventor: Earl J. Clark, Frederick, Md.

[73] Assignee: Tandy Brands, Inc., Fort Worth, Tex.

[ * ] Notice: The portion of the term of this patent subsequent to Apr. 13, 1990, has been disclaimed.

[21] Appl. No.: 683,289

[22] Filed: May 5, 1976

[51] Int. Cl.[2] ..... F41B 13/04

[52] U.S. Cl. ..... 224/2 B; D22/14

[58] Field of Search ..... 224/2 B, 2 R, 2 C, 26 R, 224/26 B, 26 C, 26 D, 26 H, 26 J, 26 K, 5 D, 5 E, 5 R, 5 A, 5 B, 5 C, 5 H, 5 G, 5 W, 5 P, 13, 17, 18, 19, 20, 21; D22/13, 14

[56] References Cited

U.S. PATENT DOCUMENTS

| | | | |
|---|---|---|---|
| D. 166,433 | 4/1952 | Weitzman | D22/13 |
| D. 236,891 | 9/1975 | Weissenburger | D22/13 |
| D. 239,532 | 4/1976 | Clark | D22/13 |
| 3,731,858 | 5/1973 | Baker | 224/2 B |

*Primary Examiner*—Robert J. Spar
*Assistant Examiner*—Donald W. Underwood
*Attorney, Agent, or Firm*—Robert A. Felsman

[57] ABSTRACT

Disclosed herein is a holster for pistols having an improved belt loop assembly. A pair of belt loop assemblies are connected to opposite sides of the gun receiving pocket. Each assembly has an inner piece of holster material containing a slot for the reception of a belt. An outer piece free of slots is joined to the inner piece at the top and bottom, defining a belt receiving opening on the outer edge in communication with the adjacent slot. A pin depends from the loop that fastens the pistol in the holster for locking shrouded revolvers in place.

5 Claims, 6 Drawing Figures

PISTOL HOLSTER

BACKGROUND OF THE INVENTION

1. Field of the Invention

This invention relates in general to gun holsters and in particular to an improved belt loop assembly for pistol holsters.

2. Description of the Prior Art

Certain types of holsters are designed to be concealed beneath a jacket. One of these types fastens to a person's trouser belt near the bottom of the holster. Consequently much of the holster and center of gravity of the gun is above the belt. One holster of this type is described in U.S. Pat. No. 3,731,858, issued to Baker on May 8, 1973. The holster described therein utilizes two pieces of leather sewed together. Belt receiving slots are provided that extend through both pieces of leather. When the holster is installed on the belt, a portion of the belt will be on the exterior side of the holster, at the places where it is threaded through the slots.

While these holsters are successful, it is desirable for maximum concealment to decrease bulk and confine the belt to the inside of the holster.

Also, holsters for revolvers hold the revolver in place by means of a loop snapped over the handle directly behind the hammer. The hammer protrudes upwardly, preventing withdrawal. One type of revolver utilizes a shroud on each side of the hammer for safety purposes. The hammer does not protrude above the shroud, but moves in a groove, thus the loop of the holster is ineffective in hold the revolver in place.

SUMMARY OF THE INVENTION

It is accordingly an object of this invention to provide an improved gun holster.

Another object is to provide an improved belt loop assembly for a gun holster that confines the belt to the inside of the holster.

Another object is to provide an improved gun holster that will hold shrouded revolvers in place.

In accordance with these objects a holster is provided that utilizes a pair of belt-loop assemblies located on opposite sides of the gun receiving pocket. Each assembly comprises an inner piece of material having a slot for the reception of a belt joined to an outer piece of material. The inner and outer pieces are joined together, leaving their outer edges free, defining a belt-receiving opening for the insertion of a belt. The holster is carried by passing the belt through the opening and slot, thereby confining the belt to the inner side of the holster. A pin depends downwardly from the fastening loop for insertion within the groove of a shrouded revolver directly behind the hammer. Other objects, features and advantages will become apparent hereinafter.

BRIEF DESCRIPTION OF THE PREFERRED EMBODIMENT

Figure 1:
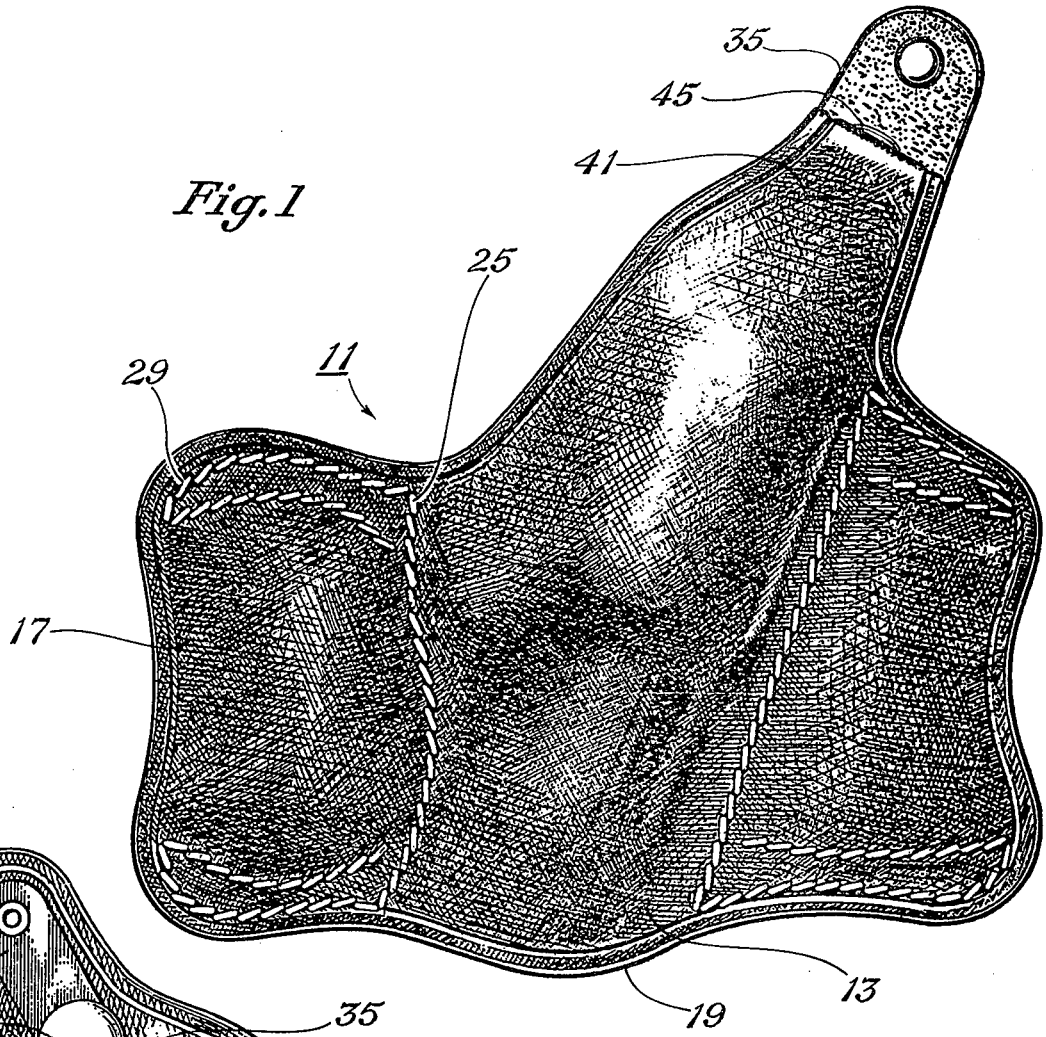
FIG. 1 is a front view of a holster constructed in accordance with the teachings of this invention.

Referring initially to FIG. 1, a holster 11 is shown viewed from its exterior side. Holster 11 is comprised of two pieces of holster material of similar configuration joined in overlying relationship. Holster material is normally leather or flexible leatherlike material.

Figure 2:
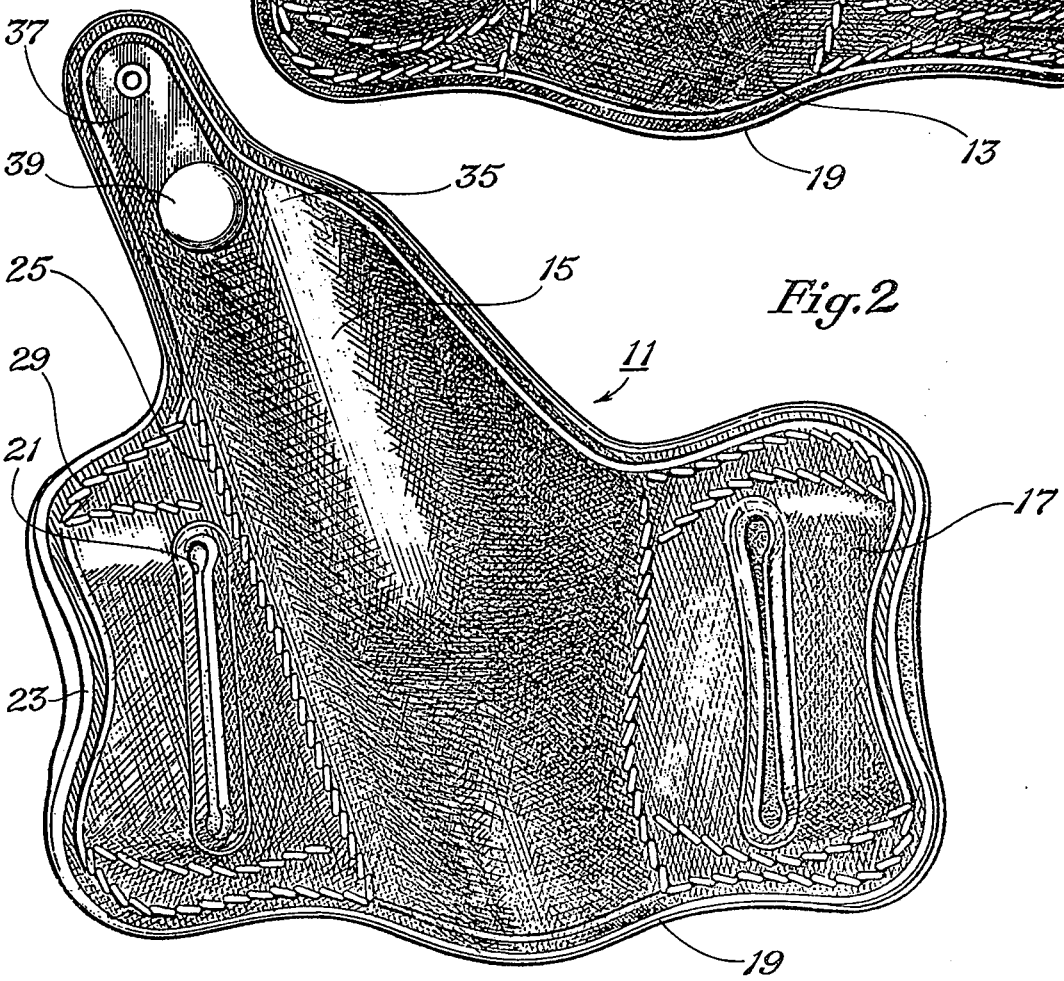
FIG. 2 is a rear view of the holster of FIG. 1.
Figure 6:
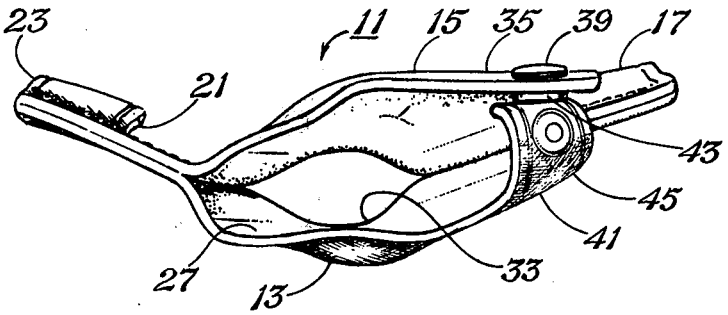
FIG. 6 is a top view in reduced scale of the holster of FIG. 1.

Both pieces, termed outer piece 13 and inner piece 15, FIG. 2, have lateral wings 17. Wings 17 are a wide portion commencing adjacent the bottom 19 of pieces 13, 15, and extending upward slightly more than one-half the height of the holster 11.

Inner piece 15 contains a belt-receiving slot 21 adjacent the side edge 23 of each wing 17. The bottom of slot 21 is adjacent bottom 19. Outer piece 13 does not have slots.

Outer piece 13 and inner piece 15 are stitched together by two rows of stitches 25 intermediate slots 21 extending substantially the vertical length of each wing 17. The portion between each row of stitches 25 is shaped to define a gun-receiving pocket 27, shown more clearly in FIGS. 3–6. Stitches 29 are also sewn adjacent the top and bottom edges of each lateral wing 17. Side edges 23 remain unstitched, and are shaped to define a belt-receiving opening 31, FIGS. 3 and 4. Wings 17, slot 21, and opening 31 comprise a belt loop assembly.

Figure 3:
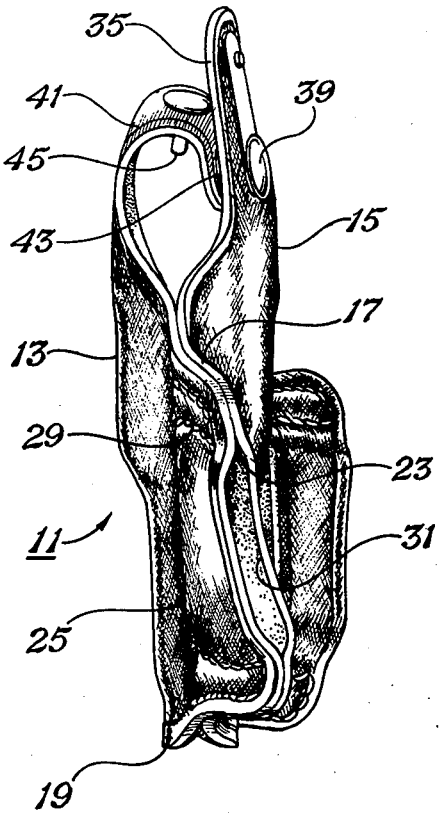
FIG. 3 is a side view in reduced scale of the holster of FIG. 1 as seen from the right side.
Figure 4:
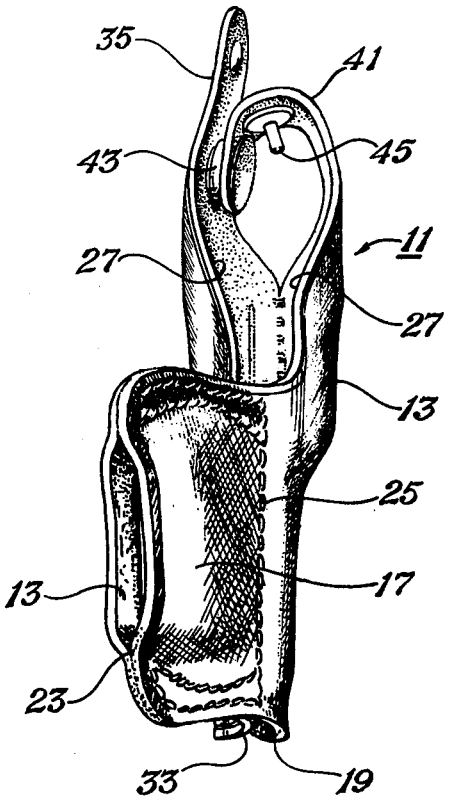
FIG. 4 is a side view in reduced scale of the holster of FIG. 1 as seen from the left side.
Figure 5:
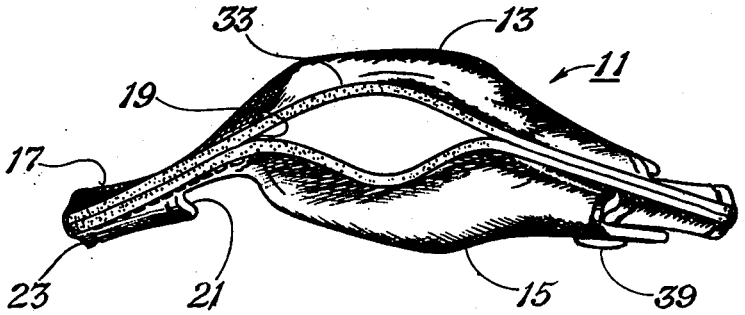
FIG. 5 is a bottom view in reduced scale of the holster of FIG. 1.

Each belt loop assembly is shaped to form a curved surface in conjunction with pocket 27, as shown in FIGS. 3 and 4. Pocket 27 has a lower opening 33 for receiving the muzzle of a pistol. Inner piece 15 has an upwardly extending portion 35 at the top to which a metal strip 37 and snap 39 are attached. Outer piece 13 has a similar upwardly extending portion or tab 41 to which a snap 43 is fastened. Tab 41 is foldable, forming a loop when fastened to the inner piece 15, as shown in FIGS. 3 and 4. Metal strip 37 facilitates unsnapping the portions 35, 41, for fast drawing.

A pin 45 is attached to tab 41 directly below snap 43, extending inwardly. When tab 43 is folded over with snap 43 fastened to snap 39, pin 45 will point downward. The pin is preferably plastic and is about ⅜ inch long. Pin 45 is for use with shrouded revolvers. These revolvers (not shown) have a shroud or housing attached or formed with the revolver on each side of the hammer. The hammer moves in a groove in the shroud, with little or no part of it extending above the shroud. The shroud prevents the gun from being cocked by the hammer, thus is a safety device. With a non-shrouded revolver, tab 41 fastens directly behind the hammer of the revolver, preventing its withdrawal. With shrouded pistols, the hammer does not protrude, thus tab 41 by itself is ineffective to prevent withdrawal. Pin 45 provides the means to prevent withdrawal of shrouded revolvers. It inserts within the groove directly behind the hammer, preventing movement of the hammer and revolver. Pin 45 is not necessary if the holster is to be used with an unshrouded pistol.

To use holster 11, the user's trouser belt (not shown) is initially inserted through one opening 31. The belt is then passed through the adjacent slot 21 in communication with opening 31. Thence it passes along inner piece 15 to the other slot 21. It is inserted in this slot 21 and drawn out of the other opening 31. No portion of the belt will be carried on the exterior side of outer piece 13. A pistol (not shown) fits within pocket 27 with its hammer in front of the loop adjacent snaps 39 and 43.

It can readily be seen that an invention having significant improvements has been provided. The belt loop assembly described confines the belt to the inner side of the holster, preventing bulges and allowing maximum concealment. The belt loop assembly is simple to construct and provides a high degree of support to the holster. The pin depending from the tab allows the holster to be used for shrouded pistols.

Although the invention has been described with a certain degree of particularity, it is understood that numerous changes in the details of construction may be resorted to without departing from the spirit and the scope of this invention. For example, the belt loop assembly could be adapted to holsters of different design than the one shown in the drawings and does not have to be formed integrally with the holster.

I claim:

1. A revolver holster comprising:

an outer and an inner piece of material;

each piece having lateral wings;

the holster having a belt-receiving slot extending only through each wing of the inner piece;

the pieces being joined together in overlying relationship intermediate, on the top, and on the bottom of the wings, defining a revolver-receiving pocket;

the pieces remaining unjoined at the lateral edges of the wings, defining belt-receiving openings;

whereby the holster is carried on a belt by passage of the belt through the openings and slots, with no portion of the belt being on the exterior side of the outer piece.

2. The revolver holster of claim 1 wherein the pieces are joined by stitches.

3. The revolver holster of claim 1 wherein the bottom of the belt-receiving slots and the belt-receiving openings are adjacent the bottom of the holster.

4. A revolver holster comprising:

an outer and an inner piece of material joined together in overlying relationship;

a belt-receiving slot adjacent each side edge of the inner piece;

the outer piece being free of slots;

the inner and outer piece being stitched together intermediate the slots, defining a revolver-receiving pocket, and on the top and bottom of the slots, but separated at the side edge defining a belt-receiving opening between the outer and inner pieces on each side in communication with its adjacent slot;

whereby a belt connected to the holster passes through one belt-receiving opening thence out one slot and into the other slot, thence out the other belt-receiving opening, thereby confining the belt to the inner side of the holster.

5. The revolver holster of claim 4 wherein the holster has a tab extending from its upper portion that is foldable and has a snap for fastening the revolver in the holster; and further comprising a pin extending inwardly from the tab adjacent the snap for insertion within the groove of shrouded revolvers.

* * * * *